US010111471B2

(12) United States Patent
Madine

(10) Patent No.: US 10,111,471 B2
(45) Date of Patent: Oct. 30, 2018

(54) OFFICIALS CLOTHING WITH MAGNETIC WHISTLE HOLDER

(71) Applicant: Patrick C. Madine, Copley, OH (US)

(72) Inventor: Patrick C. Madine, Copley, OH (US)

( * ) Notice: Subject to any disclaimer, the term of this patent is extended or adjusted under 35 U.S.C. 154(b) by 0 days.

(21) Appl. No.: 15/484,984

(22) Filed: Apr. 11, 2017

(65) Prior Publication Data

US 2017/0303599 A1 Oct. 26, 2017

Related U.S. Application Data

(60) Provisional application No. 62/325,115, filed on Apr. 20, 2016.

(51) Int. Cl.

| | |
|---|---|
| ***A45F 5/02*** | (2006.01) |
| ***A41B 9/06*** | (2006.01) |
| ***A41D 1/04*** | (2006.01) |
| *A41F 1/00* | (2006.01) |
| *A41D 13/00* | (2006.01) |

(52) U.S. Cl.

CPC ..... *A41B 9/06* (2013.01); *A41D 1/04* (2013.01); *A45F 5/02* (2013.01); *A41D 13/0015* (2013.01); *A41F 1/002* (2013.01); *H05K 999/99* (2013.01)

(58) Field of Classification Search

CPC ..... Y10T 24/32; A41D 1/04; A45F 2005/006; A41B 9/06; A41F 1/002

USPC ..... 224/183; 24/303

See application file for complete search history.

(56) References Cited

U.S. PATENT DOCUMENTS

| | | | | |
|---|---|---|---|---|
| 3,171,176 | A | 3/1965 | Shirley | |
| 5,914,176 | A * | 6/1999 | Myers | A41D 27/08 156/241 |
| 7,360,334 | B2 * | 4/2008 | Christiansen | A01K 77/00 2/94 |
| 2004/0148740 | A1 | 8/2004 | Amone | |
| 2010/0308089 | A1 * | 12/2010 | Chien | A45F 5/00 224/183 |
| 2011/0000422 | A1 * | 1/2011 | Uribe | G09F 9/37 116/307 |
| 2012/0148991 | A1 * | 6/2012 | Coutlee | G10K 5/00 434/247 |
| 2014/0159840 | A1 * | 6/2014 | Qadri | H04B 1/3888 335/285 |
| 2015/0101096 | A1 * | 4/2015 | Turner | A41D 13/05 2/23 |
| 2016/0007722 | A1 * | 1/2016 | Macon | A41F 1/002 2/426 |
| 2016/0091183 | A1 * | 3/2016 | Leonard | G08B 5/004 362/190 |
| 2016/0198838 | A1 * | 7/2016 | Abreu | A45F 5/02 224/183 |

* cited by examiner

*Primary Examiner* — Scott McNurlen
(74) *Attorney, Agent, or Firm* — Zollinger & Burleson Ltd.

(57) ABSTRACT

A shirt includes a magnetic whistle holder that holds an official's whistle, a metal lanyard whistle clip, or a metal anchor carried near the whistle against the official's shirt. The magnetic holder maintains the whistle in a predictable location for ready grasping and prevents the whistle from swinging randomly from the lanyard and bouncing into the referee's body while the official is running.

8 Claims, 2 Drawing Sheets

OFFICIALS CLOTHING WITH MAGNETIC WHISTLE HOLDER

CROSS REFERENCE TO RELATED APPLICATIONS

This application claims the benefit of U.S. Provisional Patent Application Ser. No. 62/325,115 filed Apr. 20, 2016; the disclosures of which are incorporated herein by reference.

BACKGROUND OF THE DISCLOSURE

1. Technical Field

The disclosure generally relates to clothing with integrated accessory or tool holders and, more particularly, to clothing worn by a sports official wherein the clothing has a magnetic holder for the official's whistle. Specifically, the disclosure relates to an official's shirt having an integrated magnetic whistle holder that retains the official's whistle against the shirt while readily releasing the whistle when used by the official.

2. Background Information

Many sports officials carry a whistle that allows the official to alert the players to a stoppage of play. The whistle has to be carried in a position where it is readily available for use by the official to signal a stoppage in play. Some carry the whistle in their hand and others allow the whistle to hang from a lanyard around the neck or attached to a lanyard with the whistle being carried in a shirt pocket. Those who allow the whistle to hang from a lanyard are often annoyed by the movement of the whistle while the official is running. The movement bounces the whistle off the official's chest and makes it hard to readily grasp the whistle while running. Those who hang the official's whistle in this manner desire a solution for the random, swinging movement of the whistle during the game.

SUMMARY OF THE DISCLOSURE

The disclosure provides a shirt having a magnetic whistle holder that holds the whistle, a metal lanyard whistle clip, or a metal anchor carried near the whistle against the official's shirt. The magnetic holder maintains the whistle in a predictable location for ready grasping and prevents the whistle from swinging randomly from the lanyard and bouncing into the referee's body while the official is running.

The shirt can be the primary official's shirt (for example, the black and white striped shirt) or an undershirt that is worn underneath the primary official's shirt. The magnetic holder is strong enough to provide the holding force through the primary shirt. The undershirt embodiment allows the holder to be used with a variety of different official's jerseys.

The disclosure provides different configurations for securing the magnet of the holder to the shirt. A magnet can be secured directly to the front panel of the shirt with an adhesive or with a connector such as thread. A magnet can be received in a pocket defined by the shirt. In another configuration, a pair of magnets sandwich the shirt material to hold each other to the shirt through magnetic force. Magnets can be sealed under patches of material on both sides of the shirt such that the magnets are retained inside the sealed pockets in combination with the magnetic force of the magnets themselves. These configurations can be used on an undershirt, the primary official's shirt, on a pocket of the shirt, on the pants, or on the pocket of the pants.

The disclosure also provides the combination of a shirt with a magnetic whistle holder and a lanyard having a length, that when worn with the shirt, the whistle-holding end of the lanyard is in alignment with the magnetic whistle holder.

The preceding non-limiting aspects of the disclosure, as well as others, are more particularly described below. A more complete understanding of the holder can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE DRAWINGS

Similar numbers refer to similar parts throughout the specification.

DETAILED DESCRIPTION OF THE DISCLOSURE

Figure 3:
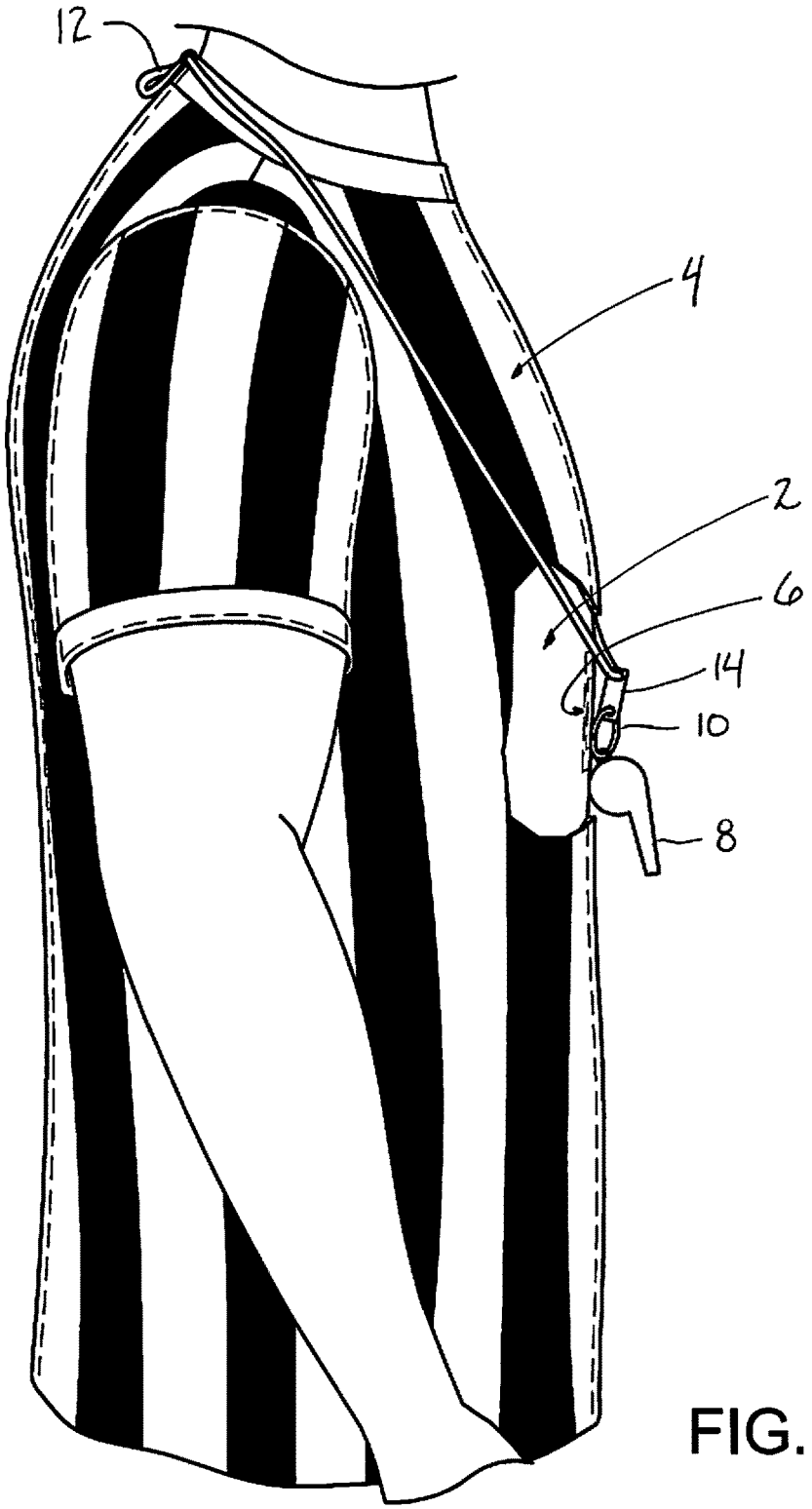
FIG. 3 is a side view of an official wearing an undershirt having the magnetic whistle holder with an official's jersey over top with the lanyard whistle holder being held by the magnet.

An exemplary configuration of an officiating shirt with a magnetic holder is indicated generally by the numeral 2 in the accompanying drawings. Shirt 2 can be a T-shirt style, long sleeve, or button-down type shirt. The exemplary configuration of shirt 2 is a T-shirt style shirt that is worn by the official under the officiating jersey 4 as depicted in FIG. 3. Shirt 2 includes a magnetic holder 6 carried by the front of shirt 2. Magnetic holder 6 can be disposed in the center of the front of shirt 2. Magnetic holder 6 provides a retaining force on a metal officiating whistle 8, the metal clasp 10 that holds whistle 8 to a lanyard 12, or a metal whistle anchor 14 added to a plastic whistle or plastic lanyard clip. The official can adjust the length of lanyard 12 so that metal clasp 10 or whistle 8 hangs directly in front of magnetic holder 6 so that holder 6 prevents whistle 8 from swinging around uncontrollably when the official is running. Holder 6 also maintains whistle 8 in a predictable location so that the official knows exactly where whistle 8 will be at any given time.

Figure 1:
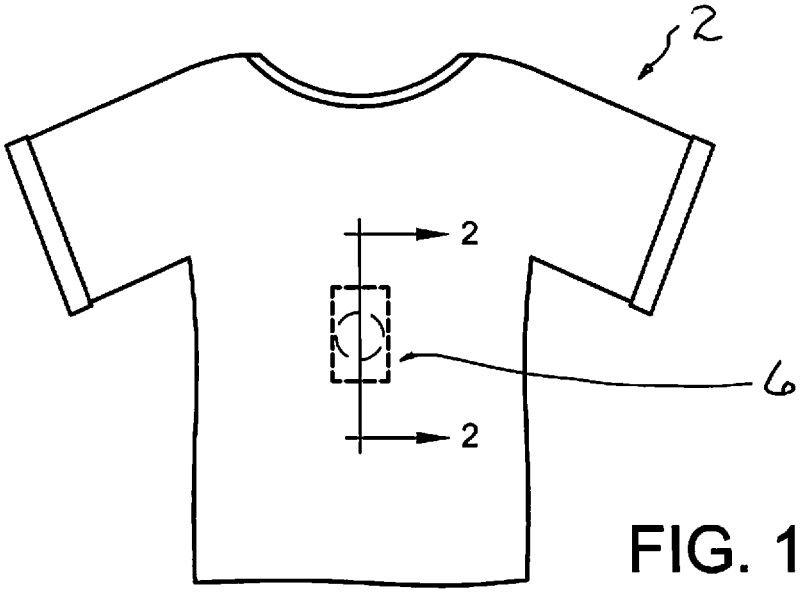
FIG. 1 is a front plan view of a shirt with a magnetic whistle holder.
Figure 2:
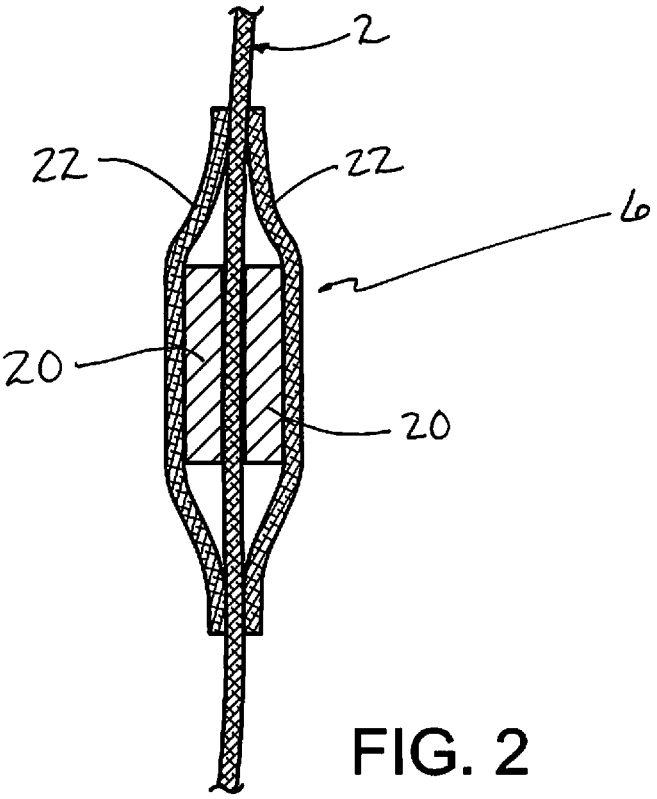
FIG. 2 is a section view taken along line 2-2 of FIG. 1.

Magnetic holder 6 includes at least one magnet 20 carried by the front body panel of shirt 2. The magnet can be carried in front of the body panel of the shirt or behind the body panel of the shirt. A single magnet 20 or a pair of magnets 20 can be used. Magnet 20 or magnets 20 can be held to the shirt body panel by a variety of fastening methods. Magnet 20 can be secured with a mechanical faster, and adhesive, or a pair of magnets 20 can sandwich the shirt material between the magnets 20 (as shown in FIG. 2). Another configuration provides a pocket for magnet 20 or two pockets for two magnets 20.

In the configuration of shirt 2 depicted in the drawings, two magnets sandwich the material of the clothing. In addition, each magnet 20 is secured to the clothing by a patch 22 that is stitched, fused, or adhesively-secured to the shirt body. When the clothing material is primarily a polymer-based clothing, a polymer patch can be used and fused under heat and pressure. Magnets 20 can be secured to one another on either side of the clothing material, patches 22 are positioned over magnets 22, and then pressure and heat are simultaneously applied to fuse the patch material to the nothing material. An adhesive or additional bonding polymer may be added to promote the connection. Although this patch 22 allows some movement of magnet 20 under patch 22, patch 22 is sealed entirely about the circumference or perimeter of patch 22 to retain it in place. Patch 22 can be provided as a pressure sensitive tactile twill. The adhesive of patch 22 can be heat activated. Both inner and outer patches 22 can be pressed and heated in a single step.

In the exemplary configuration, each magnet 20 is a grade N35 magnet provided in a round disc shape having a one inch diameter and a quarter inch thick. These magnets are strong enough to retain the lanyard clip 10 and whistle 8 while the official is running. The retention force is strong enough to function through the exterior officiating jersey 4 when the magnets 20 are carried by the undershirt 2. Undershirt 2 can be provided as a polyester material shirt.

In configurations where the official's lanyard has a plastic clip 10 and the whistle 8 is plastic, a metal anchor 14 such as a clip or washer can be added to lanyard 12 to hold it in place.

These configurations can be used on an undershirt, the primary official's shirt, on a pocket of the shirt, on the pants, or on the pocket of the pants.

The foregoing description has been made with reference to exemplary embodiments. Modifications and alterations of those embodiments will be apparent to one who reads and understands this general description. The present disclosure should be construed as including all such modifications and alterations insofar as they come within the scope of the appended claims or equivalents thereof.

The relevant portion(s) of any specifically referenced patent and/or published patent application is/are incorporated herein by reference.

The invention claimed is:

1. An official's clothing assembly comprising:

an official's outer shirt having a neck opening;

a whistle carried by a lanyard; the lanyard having a neck opening aligned with the neck opening of the official's shirt;

an undershirt having a magnetic whistle holder disposed at a first portion of material; the undershirt adapted to be worn by the official under the official's outer shirt;

the first portion having an inner surface and an outer surface;

a first magnet disposed against the inner surface of the first portion of material;

a second magnet disposed against the outer surface of the first portion of material;

the first and second magnets attracting each other with magnetic force to hold themselves to the first portion of material;

a first patch disposed over the first magnet; the first patch being connected to the first portion of material entirely about the first magnet;

a second patch disposed over the second magnet; the second patch being connected to the first portion of material entirely about the second magnet; and the whistle being held in position with respect to the official's shirt by the magnetic whistle holder.

2. The article of claim 1, wherein each of the first and second patches are fused to the first portion of material.

3. The article of claim 1, wherein each of the first and second patches are pressure sensitive tactile twill.

4. The article of claim 1, wherein the first portion of material is polyester.

5. The article of claim 1, further comprising an adhesive connecting the patches to the first portion of material.

6. The article of claim 1, wherein each of the magnets is disc-shaped.

7. The article of claim 6, wherein each magnet has a one inch diameter and is one quarter inch thick.

8. The article of claim 1, wherein each magnet is a N35 magnet.

* * * * *